US010449596B2

(12) United States Patent
Miyashita

(10) Patent No.: US 10,449,596 B2
(45) Date of Patent: Oct. 22, 2019

(54) FORGING METHOD AND FORGING DEVICE

(71) Applicant: SHOWA DENKO K.K., Tokyo (JP)

(72) Inventor: Ichitami Miyashita, Fukushima (JP)

(73) Assignee: SHOWA DENKO K.K., Tokyo (JP)

( * ) Notice: Subject to any disclaimer, the term of this patent is extended or adjusted under 35 U.S.C. 154(b) by 367 days.

(21) Appl. No.: 15/518,085

(22) PCT Filed: Sep. 30, 2015

(86) PCT No.: PCT/JP2015/077650
§ 371 (c)(1),
(2) Date: Apr. 10, 2017

(87) PCT Pub. No.: WO2016/056435
PCT Pub. Date: Apr. 14, 2016

(65) Prior Publication Data

US 2017/0312809 A1 Nov. 2, 2017

(30) Foreign Application Priority Data

Oct. 9, 2014 (JP) ..... 2014-207885

(51) Int. Cl.
*B21J 5/00* (2006.01)
*B21J 9/02* (2006.01)
(Continued)

(52) U.S. Cl.
CPC ..... *B21J 5/006* (2013.01); *B21J 5/00* (2013.01); *B21J 5/02* (2013.01); *B21J 9/02* (2013.01); *B21J 9/20* (2013.01)

(58) Field of Classification Search
CPC ..... B21J 5/006; B21J 5/02; B21J 9/02; B21J 9/20; B21J 5/00
(Continued)

(56) References Cited

U.S. PATENT DOCUMENTS 4,854,149 A * 8/1989 Porucznik ..... B21D 51/2615 72/352
5,095,733 A * 3/1992 Porucznik ..... B21D 22/20 72/347
(Continued)

FOREIGN PATENT DOCUMENTS

JP 2001-286935 A 10/2001
JP 2004-098137 A 4/2004
(Continued)

OTHER PUBLICATIONS

International Search Report dated Nov. 17, 2015 issued in corresponding PCT/JP2015/077650 application (2 pages).
(Continued)

*Primary Examiner* — David B Jones
(74) *Attorney, Agent, or Firm* — Millen, White, Zelano & Branigan, P.C.; William Nixon

(57) ABSTRACT

Provided is a forging method capable of preventing a vibration state from being disturbed during forming. The present invention relates to a forging method in which, when a forging material W1 in a forming hole 12 of a die body 11 is plastically worked by driving a punch 2 into a forming hole 12 of the die body, ultrasonic vibrations are applied to the die body 11. The contact state of the forging material W1 with respect to a forming hole inner peripheral surface during the plastic working of the forging material W1 is classified into an insufficient contact state, a sufficient contact state, and a full contact state in order from the forming start time. An application of ultrasonic vibrations is started after shifting from the insufficient contact state to the sufficient contact state.

9 Claims, 11 Drawing Sheets

(51) Int. Cl.
*B21J 9/20* (2006.01)
*B21J 5/02* (2006.01)

(58) Field of Classification Search
USPC ..... 72/352
See application file for complete search history.

(56) References Cited

U.S. PATENT DOCUMENTS

| | | | | |
|---|---|---|---|---|
| 5,249,450 | A * | 10/1993 | Wood | B21J 5/00 228/180.22 |
| 2007/0180673 | A1* | 8/2007 | Kobayashi | B21D 39/032 29/407.01 |
| 2011/0132060 | A1* | 6/2011 | Okabe | B21J 5/08 72/377 |
| 2016/0354835 | A1* | 12/2016 | Miyashita | B21J 9/20 |
| 2017/0312809 | A1* | 11/2017 | Miyashita | B21J 5/006 |

FOREIGN PATENT DOCUMENTS

| | | | |
|---|---|---|---|
| JP | 2005-193240 | A | 7/2005 |
| JP | 2005-193266 | A | 7/2005 |
| JP | 2007-213640 | A | 8/2007 |
| JP | 2009-279596 | A | 12/2009 |

OTHER PUBLICATIONS

English Abstract of JP 2001-286935 A published Oct. 16, 2001.
English Abstract of JP 2004-098137 A published Apr. 2, 2004.
English Abstract of JP 2005-193240 A published Jul. 21, 2005.
English Abstract of JP 2005-193266 A published Jul. 21, 2005.
English Abstract of JP 2007-213640 A published Aug. 23, 2007.
English Abstract of JP 2009-279596 A published Dec. 3, 2009.

* cited by examiner

FORGING METHOD AND FORGING DEVICE

TECHNICAL FIELD

The present invention relates to a forging method and a forging device configured to perform a forging process while applying ultrasonic vibrations.

TECHNICAL BACKGROUND

Conventionally, when performing a forging process, ultrasonic forging in which ultrasonic vibrations are applied to a die during forming is well known. For example, in ultrasonic forging described in, e.g., Patent Document 1 and Non-Patent Document 1, it is stated that application of ultrasonic vibrations can attain reduction of a forming load and improvement of a shape transfer property.

Such a forging device that performs ultrasonic forging is provided with a die, a vibrator attached to the die, and an ultrasonic oscillator that drives the vibrator, and is configured to apply ultrasonic vibrations to the die with the vibrator depending on the output of the ultrasonic oscillator.

PRIOR ART

Patent Document

Patent Document 1: Japanese Unexamined Patent Application Publication No. 2009-279596

Non-Patent Document

Non-Patent Document 1: Masahiko Kami et al., "Basic Studies on Ultrasonic Micro Coining (4th Report)", "56th Plastic Working Union Lecture Presentation Papers Collection", 2005, p. 583-584

SUMMARY OF THE INVENTION

Problems to be Solved by the Invention

By the way, when the inventor of the present invention was performing ultrasonic forging using a forging device as described above, a phenomenon was confirmed that a voltage supplied from an ultrasonic oscillator to a vibrator sharply increased, causing an overload error in the ultrasonic oscillator, which resulted in stop of vibrations during the forming. As a result of investigation of the cause, it was found that the vibration state of the die became unstable during the forming, causing a declined vibrational amplitude of the vibrator due to the load of the die, whereas the voltage of the vibrator rose sharply to maintain the initial vibration state. It turned out that the output value of the ultrasonic oscillator became nearly likely to exceed the maximum output, activating the protective circuit to cause an overload error of the ultrasonic oscillator, as a result, the ultrasonic oscillator stops and therefore vibrations of the die stop.

If the vibrations of the die are stopped during the forging process as described above, it becomes impossible to assuredly attain the reduction of the forming load and the improvement of the shape transfer property, which in turn fails to obtain effects by application of ultrasonic vibrations.

The present invention was made in view of the aforementioned problems, and aims to provide a forging method and a forging device capable of preventing a vibration state from being disturbed during forming and assuredly obtaining effects due to application of vibration, such as a reduction of a forming load and an improvement of a shape transfer property.

Other objects and advantages of the present invention will be apparent from the following preferred embodiments.

Means for Solving the Problems

In order to achieve the aforementioned objects, the inventor of the present invention has extensively studied in detail the cause of the vibrations disturbance that causes an overload error of an ultrasonic oscillator during a forging forming process (step) of ultrasonic forging.

As a result, it turned out that, during the forging forming process, in a state in which the forging material is not in sufficient contact with the ultrasonic vibration die (insufficient contact state), the vibration state of the vibrator is disturbed and becomes unstable under the specific situation which will be described later, occurring the overload error of the ultrasonic oscillator as described above.

Furthermore, the present inventor repeatedly conducted careful experiments and studies. As a result, the inventor found a configuration capable of achieving the aforementioned objects and has accomplished the present invention.

That is, the present invention is summarized as follows.

[1] A forging method in which ultrasonic vibrations are applied to a die body when a forging material in a forming hole of the die body is subjected to plastic working by driving a punch into the forming hole, wherein a contact state of the forging material with respect to a forming hole inner peripheral surface in a process of subjecting the forging material to the plastic working is classified into an insufficient contact state, a sufficient contact state, and a full contact state in order from a forming start time, and wherein application of ultrasonic vibrations is started after shifting from the insufficient contact state to the sufficient contact state.

[2] The forging method as recited in the aforementioned Item [1], wherein the application of ultrasonic vibrations is started immediately after shifting to the sufficient contact state.

[3] The forging method as recited in the aforementioned Item [1] or [2], wherein a distance between two adjacent contact points among contact points of the forging material with respect to the forming hole inner peripheral surface along the forming hole inner peripheral surface is defined as a distance between adjacent contact points, wherein when a maximum value of the distance between adjacent contact points exceeds a half of an entire peripheral length of the forming hole, the contact state is classified as the insufficient contact state, and wherein when a maximum value of the distance between adjacent contact points is equal to or less than a half of an entire peripheral length of the forming hole, the contact state is classified as the sufficient contact state.

[4] The forging method as recited in any one of the aforementioned Items [1] to [3], wherein an angle formed by a line segment connecting one of adjacent two contact points among contact points of the forging material with respect to the forming hole inner peripheral surface and a forming hole center and a line segment connecting the other of the adjacent two contact points and the forming hole center is defined as a central angle between adjacent contact points, wherein when a maximum value of the central angle between adjacent contact points exceeds 180°, the contact state is classified as the insufficient contact state, and wherein when the maximum value of the central angle between adjacent contact points is 180° or less, the contact state is classified as the sufficient contact state.

[5] The forging method as recited in any one of the aforementioned Items [1] to [4], wherein, based on an elapsed time from a time when processing of the forging material by the punch is started, a time of shifting from the insufficient contact state to the sufficient contact state is obtained, and wherein, based on the obtained time, a timing at which application of the ultrasonic vibrations is started is determined.

[6] The forging method as recited in any one of the aforementioned Items [1] to [4], wherein a load of the punch against the forging material at the timing of shifting from the insufficient contact state to the sufficient contact state is obtained, and wherein, based on the obtained load, a timing at which application of ultrasonic vibrations is started is determined.

[7] A forging device comprising:

a die body including a forming hole;

a punch that performs plastic working of a forging material in the forming hole by being driven into the forming hole;

vibration applying means that applies ultrasonic vibrations to the die body; and vibration start means that starts application of ultrasonic vibrations by driving the vibration applying means when a predetermined time has elapsed after start of forming the forging material by the punch.

[8] A forging device comprising:

a die body including a forming hole;

a punch that performs plastic working of a forging material in the forming hole by being driven into the forming hole;

vibration applying means that applies ultrasonic vibrations to the die body; and load detecting means that detects a load of the punch against the forging material; and vibration start means that starts application of ultrasonic vibrations by driving the vibration applying means at a timing at which the load of the punch has reached a preset vibration start load value based on information from the load detecting means.

[9] A forging device comprising:

a die body including a forming hole;

a punch that performs plastic working of a forging material in the forming hole by being driven into the forming hole; and vibration applying means that applies ultrasonic vibrations to the die body, wherein it is configured such that, at a timing at which a load of the punch against the forging material has reached a vibration start load value, application of the ultrasonic vibrations is started by the vibration applying means, and wherein it is configured such that following relationships are satisfied;

$$\text{“}Lc1\text{”}=\text{“}Lpa\text{”}\times\text{“}R\sigma\text{”}\times\text{“}\alpha=0.69 \text{ to } 1.87\text{”};$$

$$\text{“}Lpa\text{”}=0.3404\times\text{“}Ap\text{”}^{(0.782-[Ap]/190000)}\times\text{“}Aid\text{”}^{0.218}.$$

$$\text{“}R\sigma\text{”}=0.007\times\text{“}\sigma m\text{”}-0.016;$$

$$\text{“}\sigma m\text{”}>10 \text{ MPa; and}$$

$$\text{“}Did\text{”}-\text{“}Dm\text{”}<10 \text{ mm},$$

wherein “Lc1” is a vibration start load value, “Ap” is an area of a pressure surface of the punch, “Aid” is a cross-sectional area of the forming hole, “Dip” is an outer diameter of the punch, “Dm” is an outer diameter of the forging material, and “σm” is a deformation resistance of the forging material.

Effects of the Invention

According to the forging method of the invention as recited in the aforementioned Item [1], after shifting of the contact state of the forging material against the forming hole inner peripheral surface from the insufficient contact state to the sufficient contact state, application of ultrasonic vibrations to the die body is started. Therefore it is possible to assuredly prevent the vibration mode from being disturbed and becoming unstable, and assuredly obtain effects by the vibration application, such as, e.g., reduction of the forming load and improvement of the shape transfer property.

According to the forging method of the invention [2], it is possible to sufficiently apply vibrations to the die body, and effects due to the vibration application can be more assuredly obtained.

According to the forging method of the invention as recited in the aforementioned Item [3] and [4], the insufficient contact state and the sufficient contact state can be clearly distinguished, and therefore the aforementioned effects can be more assuredly obtained.

According to the forging method of the invention as recited in the aforementioned Item [5], since the time of shifting to the sufficient contact state is predicted based on the elapsed time, the timing of starting application of ultrasonic vibrations can be easily obtained.

According to the forging method to the invention as recited in the aforementioned Item [6], since the load of the punch for shifting to the sufficient contact state is predicted based on the load of the punch, the timing of applying ultrasonic vibrations can be accurately obtained.

According to the forging method to the inventions as recited in the aforementioned Item [7] to [9], a forging device capable of assuredly performing the aforementioned method invention can be provided.

EMBODIMENTS FOR CARRYING OUT THE INVENTION

(1) First Embodiment

Figure 1:
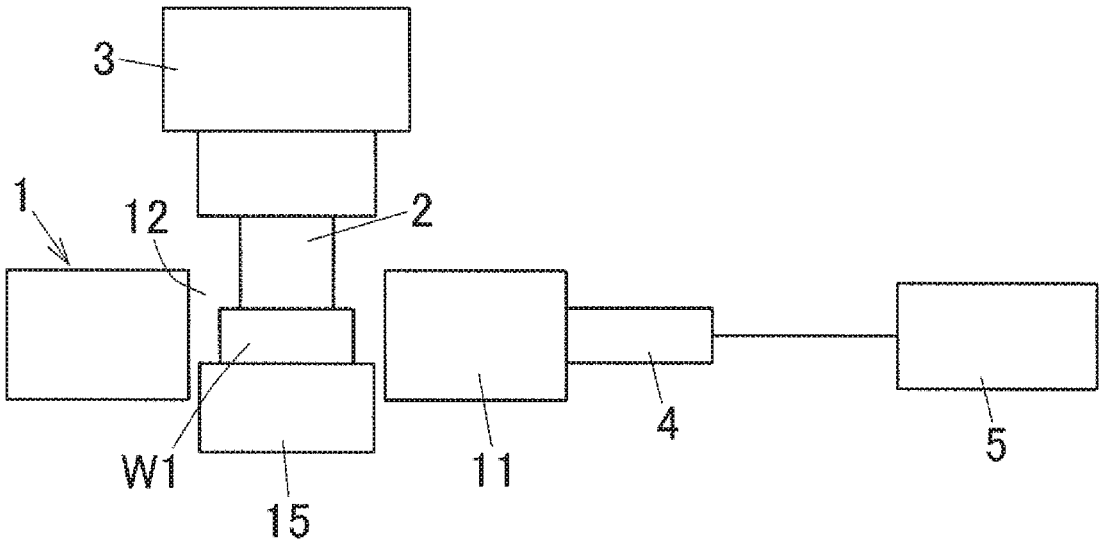
FIG. 1 is a block diagram showing a forging device capable of performing a forging method according to a first embodiment of the present invention.
Figure 2A:
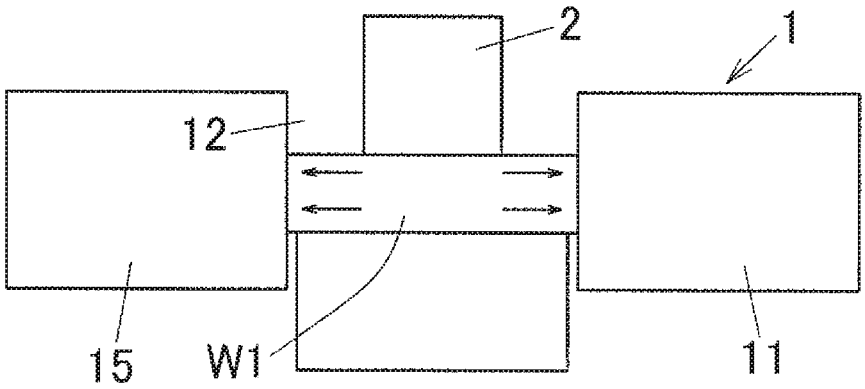
FIG. 2A is a block diagram showing a state immediately after start of forming in a forging die applied to the forging device according to the embodiment.
Figure 2B:
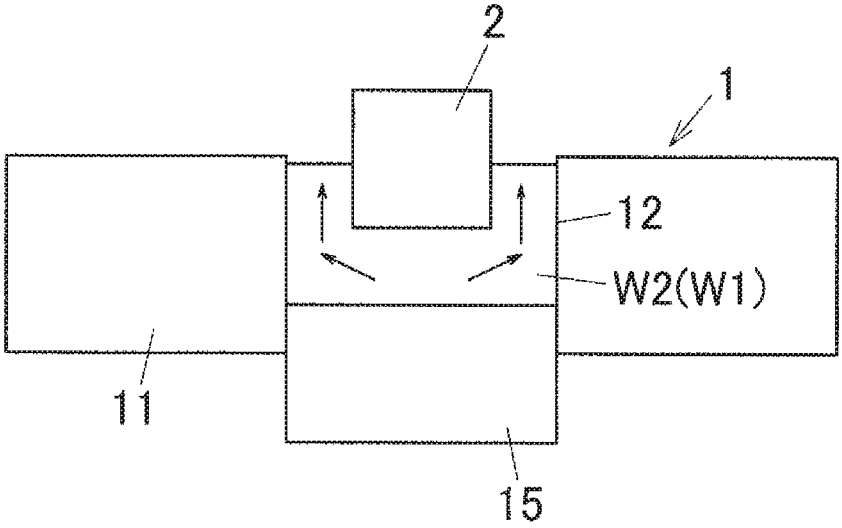
FIG. 2B is a block diagram showing a state immediately before completion of the forming in the forging die according to the embodiment.

FIG. 1 is a block diagram showing a forging device capable of performing a forging method according to a first embodiment of the present invention, and FIGS. 2A and 2B are block diagrams each showing a die of the forging device. As shown in these figures, this forging device is configured to perform plastic working to the forging material W1 to form a cup-shaped forged product W2.

This forging device is provided with a die 1 constituting a lower die, a punch 2 constituting an upper die, a lift drive mechanism 3 for driving up and down the punch 2, a vibrator 4 for generating ultrasonic vibrations, and an ultrasonic oscillator 5 for driving the vibrator 4, as basic constituent elements.

The die 1 is provided with a cylindrical or donut shaped die body 11 having a cylindrical forming hole 12 in the center and a forming pin 15 arranged at the lower end of the die body 11 in the forming hole 12. It is configured such that the outer peripheral surface of the forged product W2 is formed by the inner peripheral surface of the forming hole 12, and the lower surface of the forged product W2 is formed by the upper end surface of the forming pin 15.

Note that this forming pin 15 may be configured so as to be movable in the up and down direction and may also serve as a knockout pin for pushing out a forged product from the forming hole 12 after the forging process. Further, a knockout mechanism may be provided separately without using the forming pin 15 as a knockout pin.

The punch 2 has an axis aligned with the forming hole 12, and is configured to be raised and lowered by driving a lift drive mechanism 3. Then, as shown in FIG. 2A, in a state in which a forging material W1 is placed in the forming hole of the die body 11, the punch 2 is lowered and driven into the forming hole 12, whereby a predetermined forming load is applied to the forging material W1. As a result, as shown in FIG. 2B, a forged product W2 corresponding to the shape in the die is formed.

In this embodiment, a columnar shaped material is used as a forging material W, and a cup-like forged product W2 is formed.

As shown in FIG. 1, a vibrator 4 is attached to the outer peripheral surface of the die body 11. The vibrator 4 oscillates ultrasonic vibrations according to the output value of the ultrasonic oscillator 5, and the ultrasonic vibration waves oscillated from the vibrator 4 are transmitted to the die body 11 via the joint surface with the die body 11.

In the present invention, it may be configured such that a horn is interposed between the vibrator 4 and the die body 11 so that ultrasonic vibrations oscillated from the vibrator 4 are transmitted to the die body 11 via the horn.

In this embodiment, the vibrator 4 and the ultrasonic oscillator 5 constitute a vibration applying means. In the case where a horn is provided, the horn, the vibrator 4, and the ultrasonic oscillator 5 constitute the vibration applying means.

In this embodiment, as a material of the forging material W1, a material produced by a method of, e.g., cutting a continuously cast material made of aluminum (including aluminum alloys) to a predetermined length, and a material produced by a method of, e.g., compressively forming aluminum powder into a billet shape, then forming it into a round rod shape by a hot extrusion, and cutting the extruded material into a predetermined length can be used. Furthermore, a material made of a drawn material, a material made of a rolled material, etc., can also be used.

In the forging method of this embodiment, when forging a material W1 by lowering the punch 2 in a state in which the material W1 is placed in the forming hole 12 of the die 1, ultrasonic vibrations are applied from the vibrator 4 to the die body 11. This embodiment is characterized in the timing at which application of ultrasonic vibrations is started. In other words, when the vibration mode of the vibrator 4 becomes unstable, as described above, the ultrasonic oscillator 5 is overloaded and an error occurs. In this embodiment, as described in detail below, the timing of applying ultrasonic vibrations is specified to thereby prevent the vibration mode of the vibrator 4 from becoming unstable.

In this embodiment, a columnar shaped material is used as the forging material W1, but the shape of the forging material W1 is not limited to a cylindrical shape, and may be any shapes, such as, e.g., a polygonal prism shape, a spherical shape, and a polyhedral shape.

<State of Forging Material During Forming>

Figure 3:
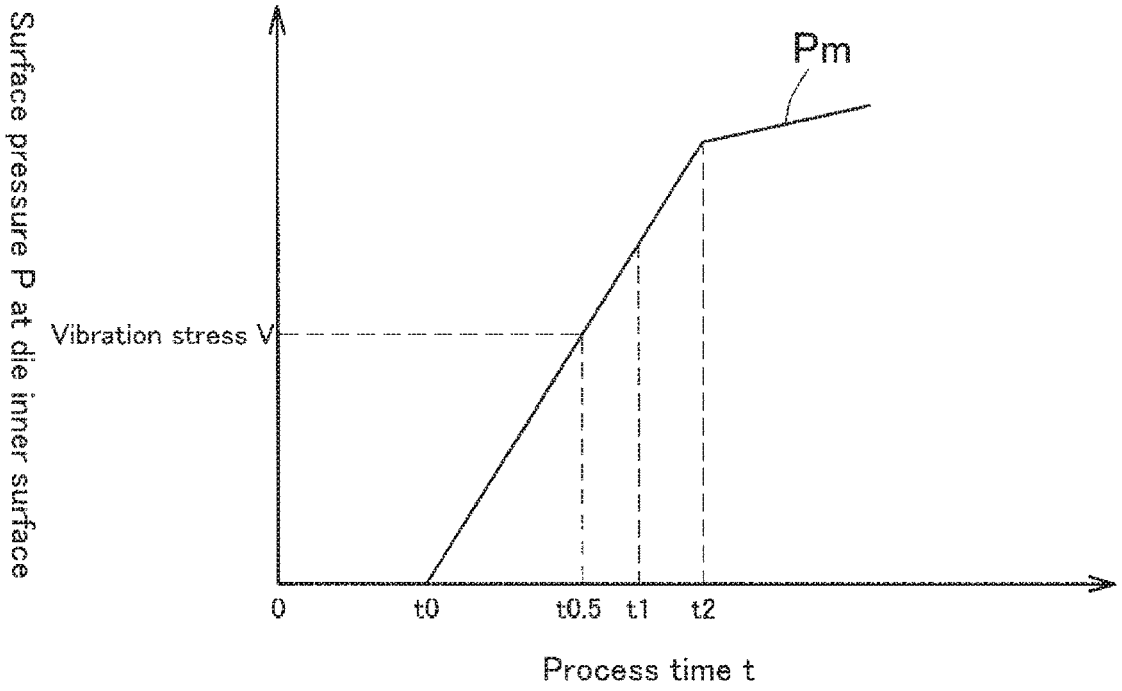
FIG. 3 is a graph showing a relationship between a surface pressure P and a process time t in ultrasonic forging.

FIG. 3 is a graph showing a relationship between a surface pressure P and a process time t in ultrasonic forging, wherein the vertical axis shows a surface pressure P and the horizontal axis shows a process time t. In this embodiment, the surface pressure P denotes a surface pressure against the forging material W1 in the forming hole inner peripheral surface. The surface pressure P is not uniform at each contact point with the forming hole inner peripheral surface, and has variations, and the line segment shown in the graph of FIG. 3 corresponds to a maximum value Pm of the surface pressure P.

In this graph, "0" of the process time t corresponds to the timing at which the forging material W1 is arranged in the forming hole 12 of the die 1. In this state, the forging material W1 and the forming hole inner peripheral surface are substantially in a non-contact state, and a certain clearance exists between them.

The time "t0" corresponds to a timing at which the forging material W1 is pressurized (plastically deformed) by the descending punch 2 and the forging material W1 starts contact with the forming hole inner peripheral surface. This time "t0" corresponds to a timing at which forming of the forging material W is started by the punch 2.

In the forging process, after this time "t0", contact points of the forging material W1 to the forming hole inner peripheral surface appear. As the forming progresses, contact points appear probabilistically and increase. That is, in the process of plastically working the forging material W1 (forging forming process), from the start of forming, the forging material W1 shifts from a state in which the forging material insufficiently contacts with the forming hole inner peripheral surface (insufficient contact state) to a state in which the forging material sufficiently contacts with the surface (sufficient contact state), and then to a state in which the forging material completely contacts with the surface (full contact state) in order.

Here, the insufficient contact state denotes a state in which the contact points of the forging material W with respect to the forming hole inner peripheral surface are arranged biased toward a part of the forming hole inner peripheral surface in the circumferential direction. The "sufficient contact state" denotes a state in which the contact points of the forging material W with respect to the forming hole inner peripheral surface are dispersedly arranged over a long range of the forming hole inner peripheral surface in the circumferential direction. The "full contact state" denotes a state in which the forging material W is in contact with the entire forming hole inner peripheral surface in the circumferential direction. The "insufficient contact state" and the "sufficient contact state" will be described later in detail.

On the other hand, the surface pressure P is from the time "0" to the time "t0", and rises from the time "t0" and gradually increases as the forming progresses.

The time "t1" corresponds to the timing of shifting from the insufficient contact state to the sufficient contact state. During the time "t0 to t1", the insufficient contact state is maintained.

At the time "t2", the forging material W1 fills the forming hole 12 and becomes the full contact state, and the forging material W1 flows between the outer peripheral surface of the punch 2 and the forming hole inner peripheral surface, which corresponds to the timing at which the formation of the peripheral wall portion of the cup-shaped forged product W2 starts.

At this time "t2", the rising of the surface pressure Pm becomes gradual, and after the time "t2", the surface pressure Pm rises with a gentle slope until the forming is completed. That is, before the time "t2", as shown in FIG. 2A, the flow (metal flow) of the material metal is only one direction in the radial direction, whereas after the time "t2", as shown in FIG. 2B, the metal flow changes in both the radial direction and the axial direction, resulting in a reduced flow in the radial direction. Therefore, at the time "t2", the rising of the surface pressure Pm becomes gentle.

<Explanation of Contact State>

Next, in this embodiment, the insufficient contact state and the sufficient contact state will be described in detail with specific examples.

Figure 4:
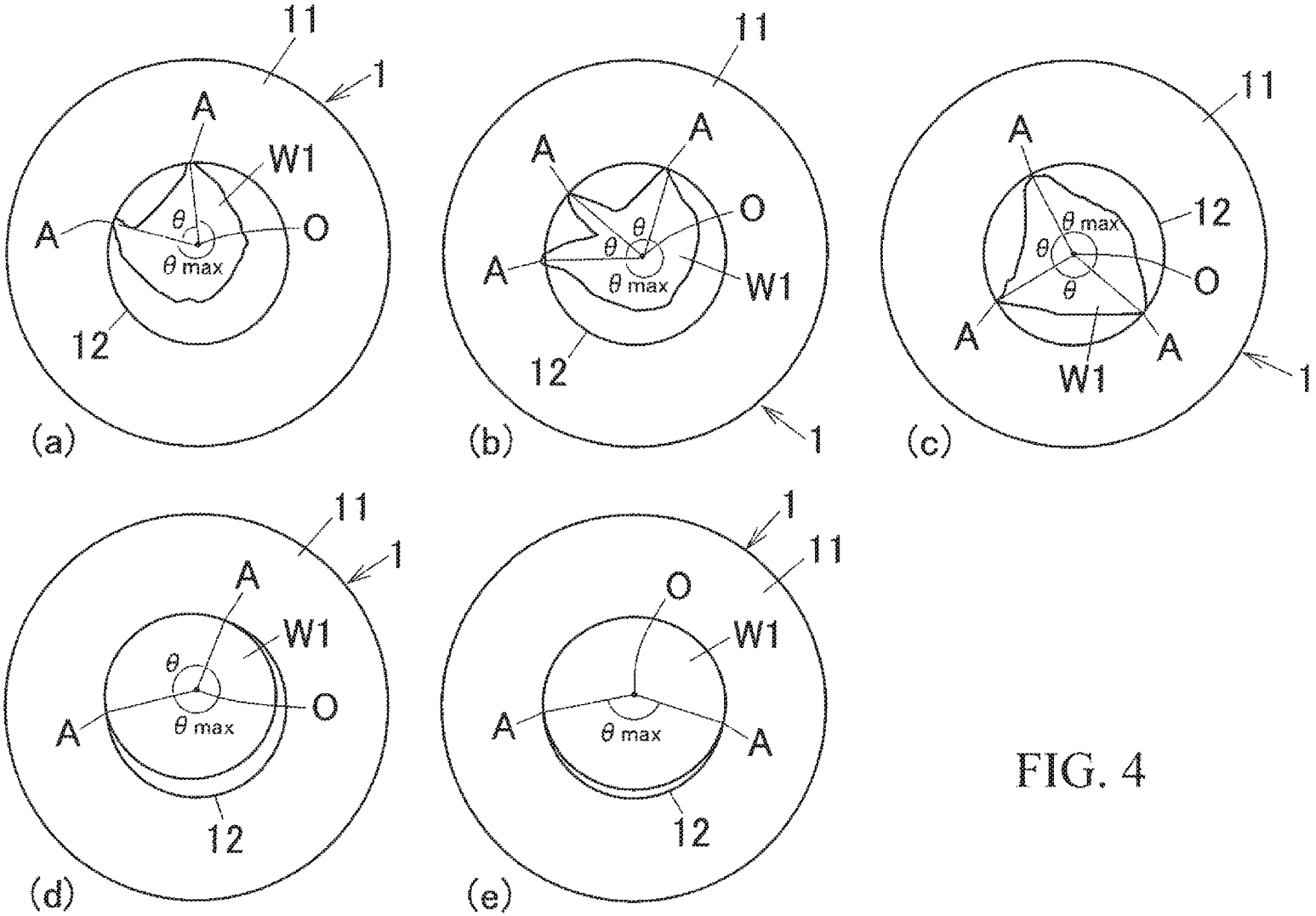
FIG. 4 is a plan view for explaining a contact state of a forging material with respect to a forming hole inner peripheral surface of a die.

FIG. 4 is a plan view for explaining the contact state of the forging material W with respect to the forming hole inner peripheral surface in the die. As shown in these figures, in a plan view state or a horizontal sectional view state, the contact point of the forging material W1 with respect to the forming hole inner peripheral surface of the die 1 is denoted as "A". In cases where there are two or more contact points A (in cases where there are plural contact points), the angle formed between a line segment AO connecting one contact point A among the two adjacent contact points A and the center O of the forming hole 12 and aline segment AO connecting the other contact point A and the center O of the forming hole 12 (the central angle between adjacent contact points) is defined as "θ". When the maximum value emax among central angles θ between adjacent contact points exceeds 180° (in the case of θmax>180°), it is defined as an insufficient contact state. When the maximum value θmax is equal to or less than 180° (θmax≤180°), it is defined as a sufficient contact state.

For example, in the examples (a) and (b) shown in FIG. 4, since the emax is greater than 180°, it is defined as an insufficient contact state. In the example (c) shown in FIG. 4, since the emax is equal to or less than 180°, it is defined as a sufficient contact state.

Further, even in cases where the forging material W1 is in line contact with the forming hole inner peripheral surface in a state of a plan view (in a horizontal sectional view), it is possible to distinguish the contact state based on the central angle maximum value emax. For example, in the example (d) shown in FIG. 4, since the emax is greater than 180°, it is defined as an insufficient contact state. In the example (e) shown in FIG. 7, since the emax is less than 180°, it is defined as a sufficient contact state.

For reference, when there are two contact points A and the central angle is 180°, it is defined as a sufficient contact state. Furthermore, when there is one contact point A, it is defined as an insufficient contact state.

In this embodiment, the center of the forming hole 12 is the least squares circle applied to the forming hole contour line (inner peripheral surface). This least squares circle is obtained by a least squares method.

Here, in this embodiment, when the distance (circumferential direction length) along the forming hole inner peripheral surface between two adjacent contact points is defined as a distance between adjacent contact points, a case in which the maximum value of the distance between adjacent contact points exceeds a half of the entire circumference length of the forming hole is a state in which a plurality of contact points A are arranged biased toward a range of less than a half of the forming hole inner peripheral surface. This state corresponds to a state in which the θmax exceeds 180° (a state of the θmax>180°), which is an insufficient contact state. A case in which the maximum value of the distance between adjacent contact points is equal to or less than a half of the entire circumferential length of the forming hole is a state in which a plurality of contact points A are arranged over a half or more than the forming hole inner peripheral surface. This state corresponds to a state in which the θmax is 180° or less (a state of θmax≤180°), and is a sufficient contact state.

Meanwhile, in this embodiment, the sectional shape (planar shape) of the forming hole 12 of the die body 11 is formed into a circular shape, but it is not limited thereto. In the present invention, the cross-sectional shape of the forming hole 12 may be formed into a non-circular shape, such as, e.g., a polygonal shape, an elliptical shape, an oval shape, and an irregular shape. In this case, the insufficient contact state and the sufficient contact state may be distinguished based on the central angle θ between adjacent contact points, or the insufficient contact state and the sufficient contact state may be distinguished based on the distance (circumferential length) between adjacent contact points.

In this embodiment, the insufficient contact state is defined by a state from the time point when the forging material W1 starts to contact with the forming hole inner peripheral surface (the forming start time) to the time point when it reaches the sufficient contact state, but not limited thereto. In the present invention, the state (non-contact state) up to the time point when forming is started after arranging the forging material W1 in the forming hole 12 may be included in the insufficient contact state. That is, the case in which there is no contact point of the forging material W1 to the forming hole inner peripheral surface (in the case of "0" contact point) may be defined as an insufficient contact state.

<Details of Vibration Disturbance>

In the ultrasonic forging, in addition to elements, such as, e.g., the contact state of the forging material W1, the surface pressure P, the process time t, it is necessary to consider the element of the vibration stress V due to ultrasonic vibrations. The vibration stress V denotes a vibration stress at the forming hole inner peripheral surface of the die body 11 vibrated by vibrations applied from the vibrator 4. This vibration stress V is a stress generated when the die body 11 expands and contracts due to vibrations, and corresponds to a vibration stress generated in the radial direction at the interface between the forming hole inner peripheral surface and the forging material W1. Since this vibration stress V is based on vibrations of the vibrator 4, it is basically kept constant irrespective of the process time t.

As shown in the graph of FIG. 3, while the surface pressure P gradually increases, the vibration stress V is kept constant. In this graph, the time "t0.5" corresponds to the timing at which the surface pressure Pm becomes equal to the vibration stress V, and after this time "t0.5", the surface pressure Pm exceeds the vibration stress V. This time "t0.5" is located between the times "t0 and t1", during this time period, it is in the insufficient contact state as described above.

In ultrasonic forging, when ultrasonic vibrations are being applied when the surface pressure P exceeds the vibration stress V (P>V) in the insufficient contact state "t0 to t1", as will be described in detail below, the vibration mode of the vibrator 4 becomes disturbed and unstable.

Figure 5A:
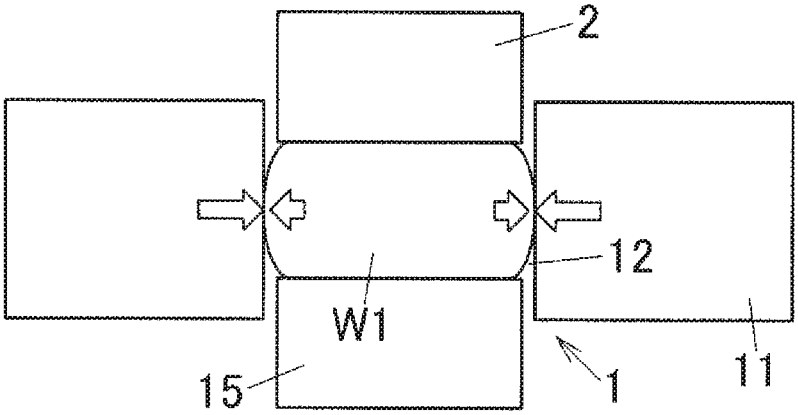
FIG. 5A is a block diagram for explaining a relationship between a surface pressure and a vibration stress in a forging die.
Figure 5B:
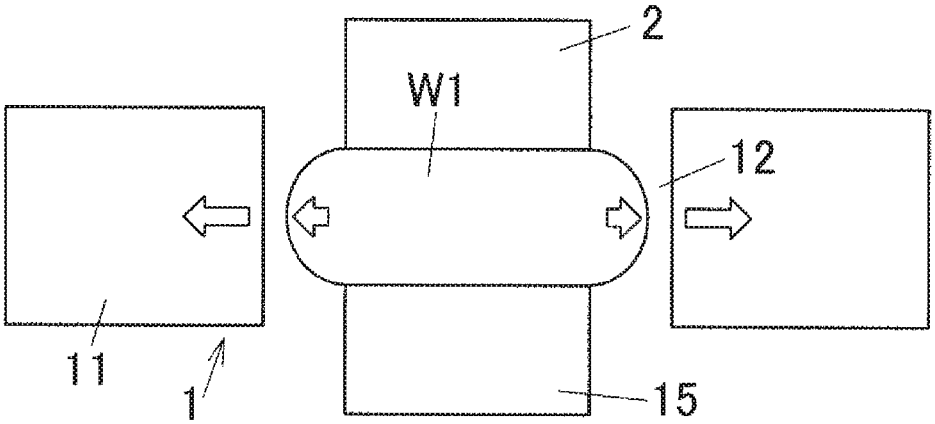
FIG. 5B is a block diagram for explaining a relationship between a surface pressure and a vibration stress in a forging die.

When the surface pressure P is lower than the vibration stress V (time "t0 to t0.5"), as shown in FIG. 5A, at the moment when the die body 11 contracts due to vibrations, the forming hole inner peripheral surface and the forging material W1 come into contact with each other, and as shown in FIG. 5B, at the moment when the die body 11 expands by vibrations, the forming hole inner peripheral surface and the forging material W1 are detached. In other words, when the surface pressure P is lower than the vibration stress V, the contact and the detachment are repeated. When contact and detachment are performed in this way, the vibration state of the die body 11 is not affected by the vibrations from the forging material W1.

Figure 5C:
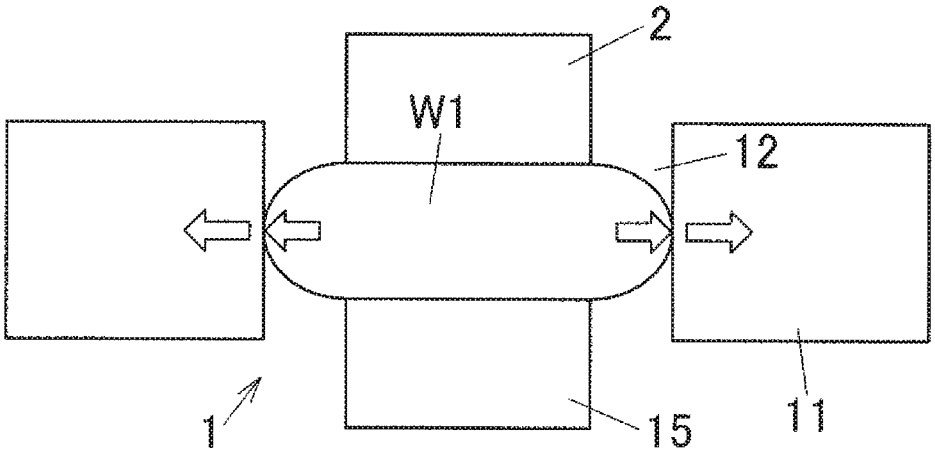
FIG. 5C is a block diagram for explaining a relationship between a surface pressure and a vibration stress in a forging die.

On the other hand, when the surface pressure P exceeds the vibration stress V, even at the moment when the die body 11 contracts as shown in FIG. 5A and even at the moment when the die body 11 expands as shown in FIG. 5C, the contact state (close contact state) between the forming hole inner peripheral surface and the forging material W1 is always maintained. In other words, at the portion where the forging material W1 is in contact with the forming hole inner peripheral surface, the forging material W1 will not be detached from the forming hole inner peripheral surface, which can be described such that they are integrated in a sense. Therefore, at the contact portion, the vibrations of the die body 11 are transmitted to the forging material W1, and the vibrations of the forging material W1 are transmitted to the die body 11.

As shown in FIG. 3, when the surface pressure P is lower than the vibration stress V (time "t0 to t0.5"), as described above, the die body 11 and the forging material W1 are individually vibrated, so they are not influenced with each other. Therefore, even in the insufficient contact state, the vibration state of the die body 11 is not disturbed and a stable vibration mode is maintained. Therefore, the vibration manner (vibration mode) of the die body 11 and the vibrator 4 is stably maintained in a predetermined mode (for example, a radial vibration mode).

However, in cases where the surface pressure P exceeds the vibration stress V (after the time "t0.5"), when it is an insufficient contact state, in the insufficient contact state, the contact points are arranged biased toward a part in the circumferential direction, so vibrations are transmitted only from the forging material W1 to the biased part (portion) of the forming hole inner peripheral surface, whereas in the remaining part (the part where no contact point exists), the forming hole inner surface and the forging material W1 are separated from each other, so vibrations will not be transmitted therebetween. Therefore, the influence of vibrations from the forging material W1 to the die body 11 is given biased in the circumferential direction. As a result, the vibration state of the die body 11 is disturbed, and due to the influence, the vibration mode of the vibrator 4 is disturbed and becomes unstable, which causes a deteriorated vibrational amplitude of the vibrator 4 and the die body 11. Then, as described above, to maintain the initial vibration mode, the voltage supplied from the ultrasonic oscillator 5 to the vibrator 4 sharply increases, causing an overload of the ultrasonic oscillator 5, which operates the safety circuit, resulting in an error. As a result, the ultrasonic oscillator 5 stops, causing stopping of vibrations of the vibrator 4 and the die body 11.

For example, at the time "t0.5" shown in FIG. 3, the surface pressure P exceeds the vibration stress V, but the contact state remains insufficient. At this time, the state of the forging material W1 with respect to the die body 11 is such that the forging material W1 contacts biased toward a part of the forming hole inner peripheral surface, and the forging material W1 vibrates with the die body 11 in the same phase. Then, a portion of the forging material W1 not in contact with the forming hole inner peripheral surface is formed, forming a crescent-shaped space between the forging material and the inner peripheral surface. As a result, in the portion, turbulence vibrations other than radial direction turbulence vibrations are generated. Thus, as described above, the vibration state is disturbed, causing an unstable vibration mode of the vibrator 4.

When the forming process advances from the insufficient contact state and shifts to the sufficient contact state, the disorder of the vibration state in the die body 11 is resolved. That is, in the sufficient contact state, since the contact points are dispersedly arranged over a long range in the circumferential direction, the vibrations of the forging material W1 are not transmitted biased toward a part in the circumferential direction of the die body 11, and are transmitted substantially evenly over the entire region of the direction. Therefore, the die body 11 and the vibrator 4 are kept in a stable vibration mode without causing disturbance of the vibration state.

When the forging forming process advances from the sufficient contact state to the full contact state, the vibrations of the forging material W1 are transmitted to the die body 11 from substantially the entire circumference in the circumferential direction in the same manner as in the sufficient contact state. Therefore, the vibrations are not transmitted from the forging material W1 biased toward the die body 11, and the die body 11 and the vibrator 4 are maintained in a predetermined vibration mode.

<Configuration and Effects>

As described above, in the ultrasonic forging, when the surface pressure P exceeds the vibration stress V in the insufficient contact state, that is, before shifting to the sufficient contact state, the vibration mode of the vibrator 4 becomes unstable. The vibrator 4 is maintained in a stable vibration mode in the state after shifting to the sufficient contact state.

Therefore, in this embodiment, by setting the timing at which application of ultrasonic vibrations by the vibrator 4 to the die body 11 is started after shifting to the sufficient contact state, it is possible to prevent the vibration mode of the vibrator 4 from becoming unstable while sufficiently securing the effects by ultrasonic vibrations. With this, the production stop due to occurrence of an overload error of the ultrasonic oscillator 5 is effectively prevented while assuredly attaining reduction of the forming load and improvement of the shape transfer property.

Further, in ultrasonic forging, as the application of ultrasonic vibrations is started as early as possible at the beginning of forging, the effects due to ultrasonic vibrations can be enhanced. For this reason, in this embodiment, it is preferable to start application of ultrasonic vibrations immediately after shifting to the sufficient contact state. Specifically, it is preferable to start application of ultrasonic vibrations within 30 ms (milliseconds) from the time point of shifting to the sufficient contact state.

(2) Second Embodiment

In the forging forming process in ultrasonic forging, as described above, the contact point A of the forging material W1 to the forming hole inner peripheral surface gradually increases with the lapse of time and the contact state changes. Therefore, based on the process elapsed time, it is possible to predict the timing of shifting from the insufficient contact state to the sufficient contact state. In this second embodiment, by starting application of ultrasonic vibrations at a predicted timing, disorder of vibrations is prevented to maintain a stable vibration mode.

Figure 6:
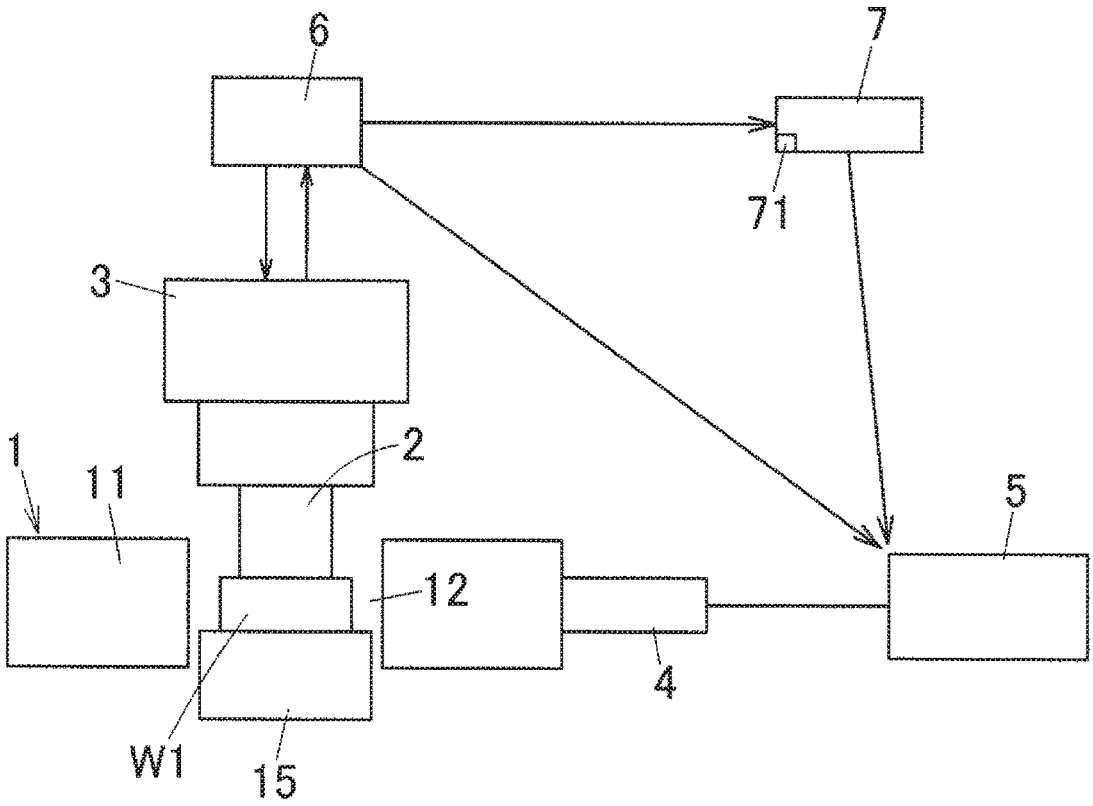
FIG. 6 is a block diagram showing a forging device capable of performing a forging method according to a second embodiment of the present invention.

FIG. 6 is a block diagram showing a forging device (forging die) capable of performing a forging method according to a second embodiment of the present invention. As shown in the figure, this forging device is equipped with a lift control device 6 and a vibration start control device 7. In the vibration start control device 7, a reference time (vibration start time) determined by, e.g., a method described later is preset. The lift control device 6 detects the time when pressing of the forging material W1 by the descending punch 2 is started based on the information from a lift drive mechanism 3. For example, in the case of a mechanical lift drive mechanism (press) 3, based on the output information from the sensor that detects a rotation angle of a crankshaft of the press, the lift control device 6 detects the time point at which the punch 2 has reached the forming start height as a forming start time. Alternatively, based on the output information from the sensor that detects a slide position of the punch 2, the lift control device 6 detects the time point at which the punch 2 has reached the forming start height as a forming start time. The lift control device 6 that detected the forming start time outputs a signal related to the forming start time to the vibration start control device 7. The vibration start control device 7 that received the signal measures the time from the forming start time (process elapsed time) based on the built-in timer 71. Then, the vibration start control device 7 transmits a vibration start signal to the ultrasonic oscillator 5 at the timing at which the measurement time has reached the aforementioned reference time. The ultrasonic oscillator 5 that received the vibration start signal outputs a power for driving the vibrator 4 to start application of vibrations by the vibrator 4 to the die body 11.

Thus, forging forming is performed in a state in which ultrasonic vibrations are being applied. For example, the voltage of the vibrator 4 may be set to 500 V to 900 V.

On the other hand, when forging forming is completed, the application of ultrasonic vibrations is stopped. That is, the lift control device 6 detects the timing at which forming is completed based on the information from the lift drive mechanism 3. For example, based on the output information from a sensor for detecting a rotation angle of a crankshaft of a press, or based on the output information from a sensor for detecting a slide position of a press, the lift control device 6 detects the time point at which the press has reached the stroke bottom dead center of the press as a forming completion time. The lift control device 6 that detected the forming completion time transmits a signal concerning the completion of forming to the ultrasonic oscillator 5. The ultrasonic oscillator 5 that received the forming completion signal stops the output to the vibrator 4, so that the ultrasonic vibrations of the die body 11 by the vibrator 4 are stopped.

Such forging forming is repeatedly performed, so that forged products are sequentially produced.

In this embodiment, the lift control device 6 and the vibration start control device 7 are configured by, for example, a microcomputer or the like. In this embodiment, the vibration start control device 7 functions as a vibration start means.

<How to Determine Vibration Start Time>

Next, a method of determining a reference time (scheduled vibration start time) will be specifically described.

Figure 7A:
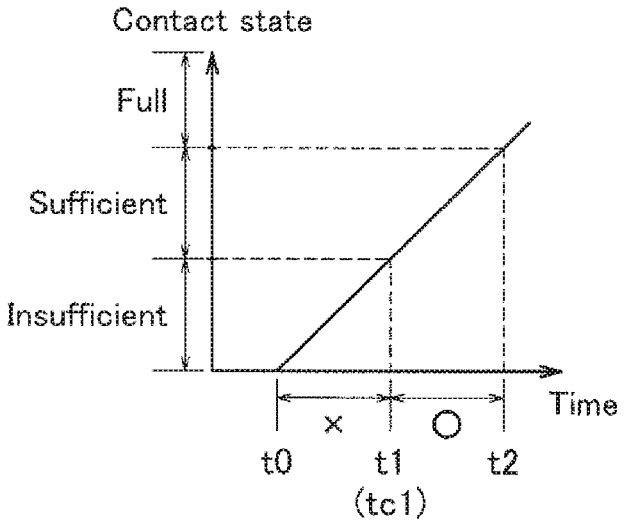
FIG. 7A is a graph showing a relationship between a contact state of a forging material and a process time in ultrasonic forging.
Figure 7B:
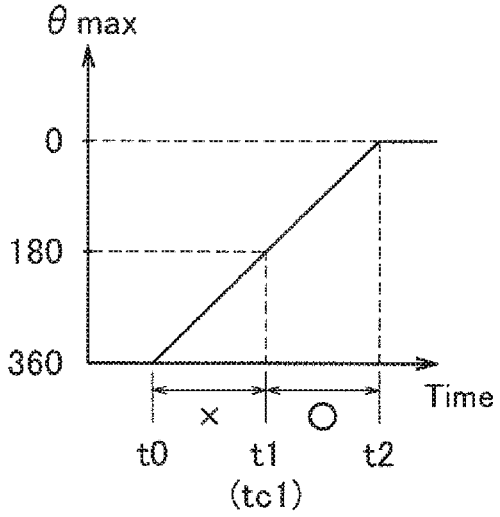
FIG. 7B is a graph showing a relationship between a central angle maximum value between contact points and a process time in ultrasonic forging.
Figure 7C:
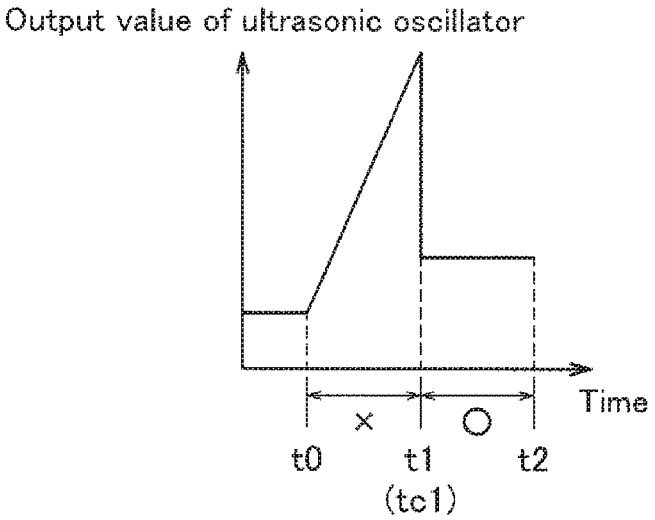
FIG. 7C is a graph showing a relationship between an output value of an ultrasonic oscillator and a process time in ultrasonic forging.

FIG. 7A is a graph showing a relationship between a contact state of a forging material and a process elapsed time. FIG. 7B is a graph showing a relationship between a central angle maximum value emax between contact points and a process elapsed time. FIG. 7C is a graph showing a relationship between an output value of an ultrasonic oscillator and a process elapsed time.

In these graphs, in the same manner as in the graph of FIG. 3, "t0" is a time indicating the timing at which the punch 2 descends and forming starts, "t1" is a time indicating the timing at which the contact state shifts from the insufficient contact state ($\theta max>180°$) to the sufficient contact state ($\theta max\leq 180°$). "t2" is a time indicating the timing at which the contact state shifts from the sufficient contact state to the full contact state ($\theta max=0°$). As can be understood from these graphs, when application of ultrasonic vibrations to the die body 11 is started at the time point (in the range indicated by "×" in these graphs) at which it has not reached "t1" yet, the vibration state of the die body 11 is disturbed, which also causes vibrations other than vibrations in the radial direction. As a result, the output value exceeds the maximum value immediately before reaching "t1", and therefore the ultrasonic oscillator stops due to the overload error. On the other hand, when application of ultrasonic vibrations is started at the time point after "t1" (in the range indicated by "0" in these graphs), the vibration state of the die body 11 will not be disturbed, no overload occurs, and a stable vibration mode is maintained.

Considering these factors, it can be understood that the time corresponding to "t1" in the forging device shown in FIG. 6 is set as a vibration start time "tc1".

Initially, in this embodiment, in the forging device shown in FIG. 6, forging forming is performed by presetting the vibration start time "tc1" to "t0" corresponding to the forming start time point.

In this forging forming, the application of ultrasonic vibrations is started too early, and therefore the vibration state is disturbed and an overload occurs in the ultrasonic oscillator. This will be confirmed here. Next, the reference time "tc1" is set to a time slightly delayed from the preset time "t0", similar forging forming is performed to confirm that an overload occurs. By repeating such an operation, the reference time "tc1" to be preset is gradually set at a later time to thereby experimentally find the earliest time among times that no overload occurs without causing disturbance of the vibration state. Then, the time is set as a regular reference time "tc1", and the reference time "tc1" is set to the forging device shown in FIG. 6. By performing ultrasonic forging as described above by the forging device in which the reference time "tc1" is set in this manner, it is possible to assuredly achieve the effects due to ultrasonic vibrations, such as, e.g., reduction of the forming load and improvement of the shape transfer property, while preventing disturbance of the vibration state and the drive stop due to occurrence of an overload error.

In this embodiment, the earliest time at which no overload error occurs is set as the reference time "tc1", but it is not limited to this. In the present invention, any time can be set as a regular reference time "tc1" as long as no overload error occurs.

According to the forging method of the second embodiment, since it determines the timing at which application of ultrasonic vibrations is started based on the elapsed time, it can be easily implemented.

Note that when predicting the timing (vibration application start timing) of shifting to the sufficient contact state based on the process elapsed time, the predicted value becomes a stochastic phenomenon and has fluctuations. In addition, the forming speed of the forging material W1 varies with various factors. Therefore, it is preferable to set a predicted value of the timing of shifting to the sufficient contact state with a margin of time. For example, a predicted value having a certain width (range) is obtained, considering surrounding environments, forming conditions, etc., an appropriate time within that range may be set as the reference time tc1.

(3) Third Embodiment

Experiments by the present inventor have revealed that there is a relationship between the load change of the punch at the time of forging forming and the contact state of the forging material. Therefore, in the third embodiment, a punch load at which the contact state shifts from the insufficient contact state to the sufficient contact state is obtained, and based on the punch load, a timing of starting application of ultrasonic vibrations is determined, so that a stable vibration mode is maintained by preventing disturbance of vibrations.

Figure 8:
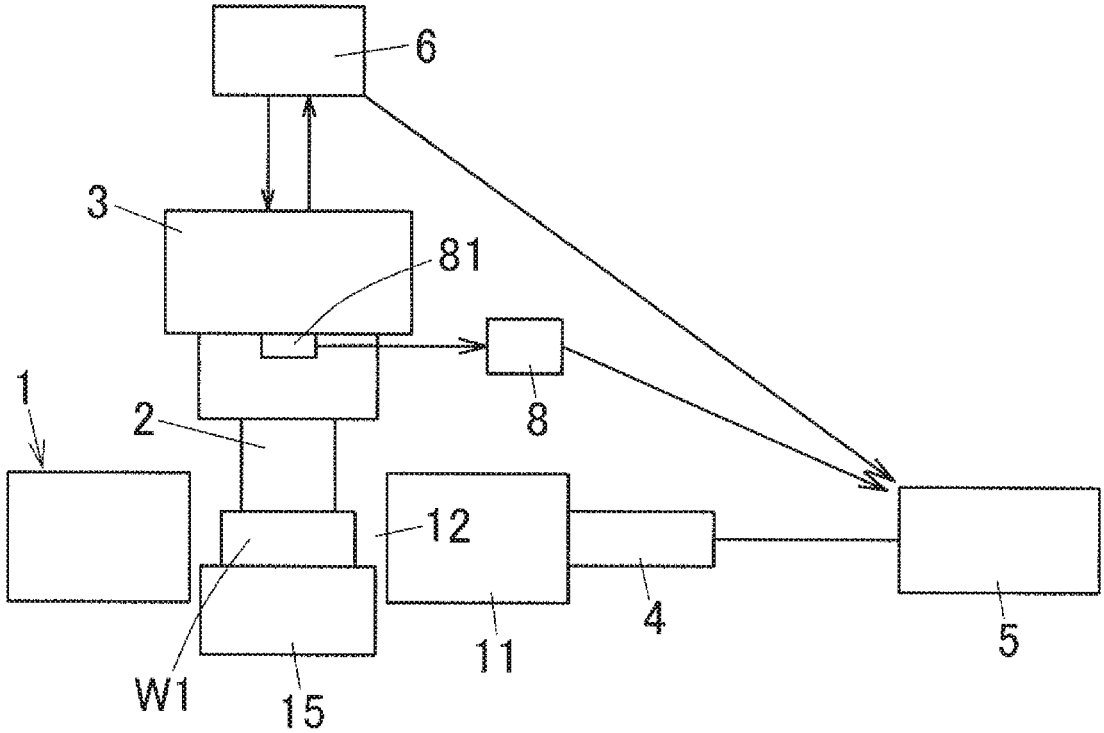
FIG. 8 is a block diagram showing a forging device capable of performing a forging method according to a third embodiment of the present invention.

FIG. 8 is a block diagram showing a forging device (forging die) capable of performing a forging method according to a third embodiment of the present invention. As shown in this figure, this forging device is provided with a load detector 81 for detecting a load of the punch 2 to the forging material W1 and a vibration start control device 8 for acquiring a signal on the punch load from the load detector 81. In the vibration start control device 8, a reference load value (vibration start load value) obtained by, e.g., a later described method is preset. The vibration start control device 8 detects the load (punch load) of the punch 2 to the forging material W based on the information from the load detector 81 when the punch 2 descends, and transmits the vibration start signal to the ultrasonic oscillator 5 at the timing at which the punch load has reached the reference load value. The ultrasonic oscillator 5 that received the vibration start signal outputs a power for driving a vibrator. Thus, the vibrator starts generation of vibrations to start application of vibrations to the die body 11.

Thus, forging forming is performed in a state in which ultrasonic vibrations are being applied. Not that, for example, the voltage of the vibrator 4 may be set to 500 V to 900 V.

On the other hand, when forging forming is completed, the application of ultrasonic vibrations is stopped. That is, the lift control device 6 detects the timing at which forming is completed based on the information from the lift drive mechanism 3, and transmits a signal concerning the completion of forming to the ultrasonic oscillator 5. Upon receiving the forming completion signal, the ultrasonic oscillator 5 stops outputting to the vibrator 4, whereby ultrasonic vibrations of the die body 11 by the vibrator 4 stops.

Such forging forming is repeatedly performed, so that forged products are sequentially produced.

In this embodiment, the vibration start control device 8 is configured by a microcomputer or the like, and functions as a vibration start means. Further, the load detector 81 functions also as a load detecting means.

<How to Determine Vibration Start Load Value>

Next, a method of determining a reference load value (vibration starting load value) will be specifically described.

Figure 9A:
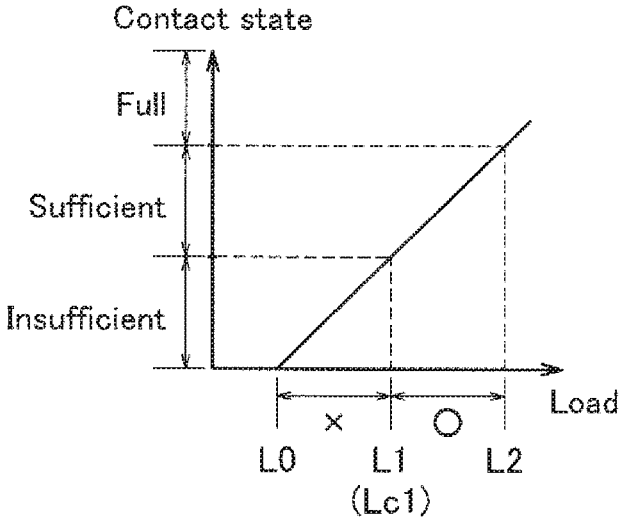
FIG. 9A is a graph showing a relationship between a contact state of a forging material and a punch load in ultrasonic forging.
Figure 9B:
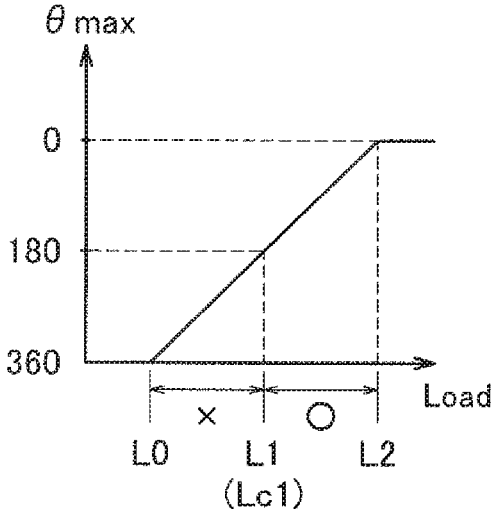
FIG. 9B is a graph showing a relationship between a central angle maximum value between contact points and a punch load in ultrasonic forging.
Figure 9C:
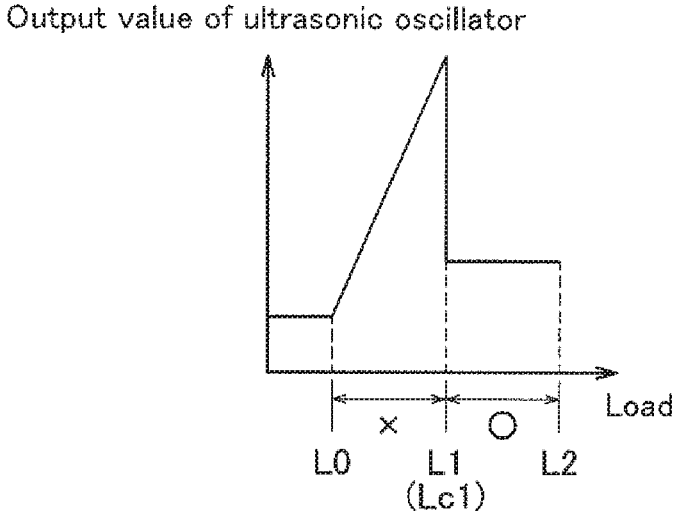
FIG. 9C is a graph showing a relationship between an output value of an ultrasonic oscillator and a punch load in ultrasonic forging.

FIG. 9A is a graph showing a relationship between a contact state of a forging material and a process elapsed time. FIG. 9B is a graph showing a relationship between a contact point central angle maximum value emax and a punch load. FIG. 9C is a graph showing a relationship between an output value of an ultrasonic oscillator and a punch load.

In these graphs, "L0" is a load value at the timing at which the punch 2 descends and forming starts, "L1" is a load value at the timing at which the contact state shifts from the insufficient contact state ($\theta max>180°$) to the sufficient contact state ($\theta max\leq 180°$). "L2" is a load value at the timing at which the contact state shifts from the sufficient contact state to the full contact state ($\theta max=0°$). As can be understood from these graphs, when application of ultrasonic vibrations to the die body 11 is started at the load value less than "L1" (in the range indicated by the "X" symbol in these graphs), the vibration state of the die body 11 is disturbed, which also causes vibrations other than vibrations in the radial direction. As a result, the output value of the ultrasonic oscillator suddenly increases immediately before reaching "L1", and therefore the ultrasonic oscillator stops due to the overload error. On the other hand, when application of ultrasonic vibrations is started at the load value "L1" or more (in the range indicated by "○" in these graphs), the vibration state of the die body 11 will not be disturbed, no overload occurs, and a stable vibration mode is maintained.

Considering these factors, it can be understood that the reference load value (vibration start load value) "Lc1" in the forging device shown in FIG. 8 is set to "L1".

Initially, in this embodiment, in the forging device shown in FIG. 8, forging forming is performed by presetting the reference load value "Lc1" to no load (0 kN). In this forging forming, the application of ultrasonic vibrations is started too early, and therefore the vibration state is disturbed, and an overload occurs in the ultrasonic oscillator. This will be confirmed. Next, the preset reference load value "Lc1" is set to a value slightly higher than 0 kN, and similar forging forming is performed to confirm that an overload occurs. By repeating such an operation, the reference load value "Lc1" to be preset is gradually set at a gradually increased value to experimentally find the smallest load among loads that no overload occurs without causing disturbance of the vibration state. Then, the load value is set as a regular reference value "Lc1", and the reference load value "Lc1" is set to the forging device shown in FIG. 8. By performing forging forming as described above by the forging device in which the reference load value "Lc1" is set in this manner, it is possible to assuredly achieve the effects due to ultrasonic vibrations, such as, e.g., reduction of the forming load and improvement of the shape transfer property, while preventing disturbance of the vibration state and the drive stop due to occurrence of overload error.

In this embodiment, the smallest load at which no overload error occurs is set as the reference load value "Lc1", but it is not limited to this. In the present invention, any load can be set as a regular reference load value "Lc1" as long as no overload error occurs.

In the forging method of the third embodiment, since the timing of shifting to the sufficient contact state (the timing of starting the vibration application) is predicted from the punch load, it is not affected by fluctuations of the forming speed of the forging material W1. Therefore, in the forging method of the third embodiment, it is possible to predict the timing to start the vibration application with high accuracy as compared with the forging method of the second embodiment in which the timing is predicted from the process elapsed time, it is possible to more assuredly attain reduction of the forming load and improvement of the shape transfer property while more assuredly preventing occurrence of an overload error.

In ultrasonic forging, as described above, it is preferable to start application of ultrasonic vibrations at the earliest possible stage. For this reason, in the forging method of the third embodiment in which it is possible to accurately grasp the timing of shifting to the sufficient contact state, the application of ultrasonic vibrations can be assuredly started at the earliest possible stage. Also from this point of view, the above effects can be obtained more assuredly.

(4) Fourth Embodiment

The forging method of the fourth embodiment is configured to determine the timing of starting application of ultrasonic vibrations based on the punch load in the same manner as in the third embodiment, but the method of determining the load value (reference load value) "Lc1" at the time of starting vibrations differs from the aforementioned third embodiment.

Here, the inventor of the present invention experimentally has obtained a knowledge that in ultrasonic forging, the shifting point at which the contact state shifts from the insufficient contact state to the sufficient contact state coincides with the boundary point of presence or absence of the overload error in the ultrasonic oscillator.

In the third embodiment, the punch load (reference load value) "Lc1" at the timing of shifting to the fully contact state is experimentally obtained in the forging die (ultrasonic vibration die). However, in the fourth embodiment, it was considered to calculate the reference load value "Lc1" using mathematical formulas.

Figure 10:
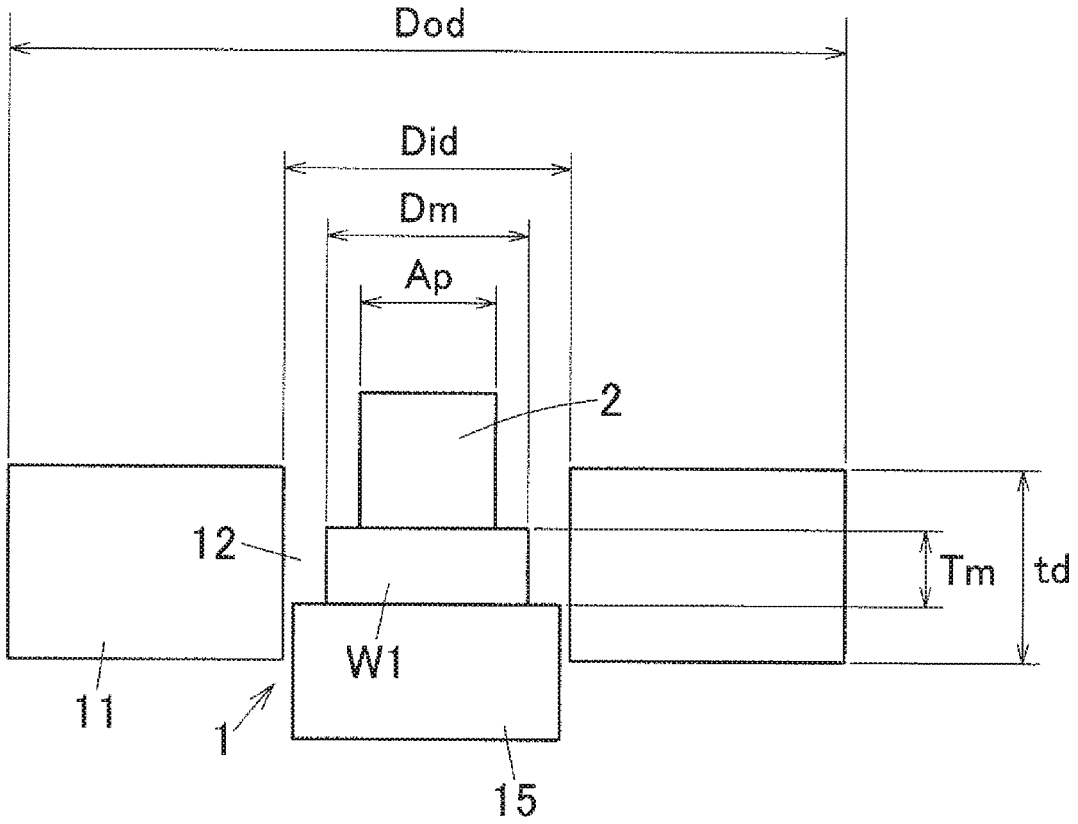
FIG. 10 is a block diagram for explaining various conditions in a die for ultrasonic forging.

As shown in FIG. 10, as various condition data in the forging die for ultrasonic forging, a punch area (area of the pressure surface) "Ap", an inner diameter "Did" of the forming hole, a sectional area "Aid" of the forming hole, a punch outer diameter "Dip", an outer diameter "Dm" of the forging material, a deformation resistance "σm" of the forging material can be exemplified. Therefore, if it is possible to derive relational formulas associating these factors and calculate the punch load at the timing of shifting to the sufficient contact state using the relational formulas, by performing ultrasonic forging using the calculated value (vibration start load value), it is possible to resolve disturbance of the vibration state and occurrence of an overload error.

First, as a method of calculating the punch load, it was considered to use the following basic model formula that applies to a simple upset forging die model. This model formula is a formula of "punch load=deformation resistance of forging material×projected area of punch×coefficient". From this model formula as a starting point, the model formula was repeatedly modified so that experiment results and analysis results by simulations match with the aforementioned various condition data as input factors. As a result, the following Formula (1-1) capable of calculating the load value (reference load value) "Lc1" at the timing of shifting to the fully contact state was found. As the software for analyzing the process of shifting from the insufficient contact state to the sufficient contact state, the plastic working analysis software (DEFORM) was used.

$$\text{“}Lc1\text{”}=\text{“}Lpa\text{”}\times\text{“}R\sigma\text{”}\times\text{“}\alpha\text{”}, \qquad \text{Formula (1-1):}$$

"Lpa" and "Rσ" in Formula (1-1) can be calculated using the following Formulas (1-2) to (1-5).

$$\text{“}Lpa\text{”}=0.3404\times\text{“}Ap\text{”}^{(0.782\ \text{“}Ap\text{”}/190000)}\times\text{“}Aid\text{”}^{0.218} \qquad \text{Formula (1-2):}$$

$$\text{“}Ap\text{”}=\text{“}Dip\text{”}\times 2\times\pi/4 \qquad \text{Formula (1-3):}$$

$$\text{“}Aid\text{”}=\text{“}Did\text{”}\times 2\times\pi/4 \qquad \text{Formula (1-4):}$$

$$\text{“}R\sigma\text{”}=0.007\times\text{“}\sigma m\text{”}-0.016(\sigma m>10\ \text{MPa}) \qquad \text{Formula (1-5):}$$

The application condition of Formula (1-1) is a case in which the clearance between the forging material and the forming hole inner peripheral surface of the die body is within a specific range. That is, when the clearance "Did−Dm"<10 mm, Formula (1-1) can be applied.

"α" is 0.69 or more and 1.87 or less ("α"="0.69 to 1.87") having a width, and its range is determined in consideration of the thickness of the forging material, the clearance "Did−Dm", and the influence of the strain rate.

As described above, by using Formula (1-1), from the inner diameter "Did" of the forming hole, the outer diameter "Dip" of the punch, the outer diameter "Dm" of the forging material, and the deformation resistance "em" of the forging material, it is possible to calculate the punch load (reference load value) "Lc1" at the timing of shifting to the sufficient contact state.

Formula (1-2) shows the influence on the reference load value "Lc1" by the punch area "Ap", and as the punch area "Ap" increases, the reference load value "Lc1" becomes higher. Formula (1-2) shows the influence on the reference load value "Lc1" by the forming hole cross-sectional area "Aid", and as the forming hole cross-sectional area "Aid" increases, the reference load value "Lc1" also becomes higher.

When the cross-section of the punch is a perfect circle, using Formula (1-3) showing the relationship between the punch area "Ap" and the punch outer diameter "Dip", the punch area "Ap" can be calculated from the punch outer diameter "Dip".

In the same manner, when the forming hole of the die body is a perfect circle, using Formula (1-4) showing the relationship between the forming hole cross-sectional area "Aid" and the forming hole inner diameter "Did", the forming hole cross-sectional area "Aid" can be calculated from the forming hole inner diameter "Did".

Further, Formula (1-5) shows the influence on the reference load value "Lc1" by the deformation resistance "σm" of the forging material, and as the deformation resistance "σm" increases, "Rσ" becomes higher, and the reference load value "Lc1" also becomes higher.

In the same manner as in the third embodiment, the vibration start load value "Lc1" calculated by the aforementioned Formula (1-1) is set to the forging device shown in FIG. 8. Further, as the forging material, for example, a material having a deformation resistance of 10 MPa or more may be used. Further, the ultrasonic vibration frequency to be applied to the die body is set to, for example, 10 to 50 kHz.

Under the conditions, by performing forging forming using the aforementioned forging device, in the same manner as described above, it is possible to prevent disturbance of the vibration state and assuredly attain reduction of the forming load and improvement of the shape transfer property while preventing occurrence of an overload error.

Here, the vibration start load value "Lc1" obtained by the aforementioned Formula (1-1) has a certain range, and the accuracy may sometimes be inferior to that of the vibration start load value "Lc1" experimentally obtained in the third embodiment. That is, Formula (1-1) uses the die size, the material deformation resistance, etc., which are main factors determining the vibration start load value "Lc1". However, in actual, other than that, it is also affected by the friction coefficient at the interface between the forging material and the die, the strain rate of the forging material, etc. Therefore, the load value "Lc1" obtained by Formula (1-1) may sometimes be inferior in accuracy. Therefore, it is preferable to set the load value "Lc1" obtained by Formula (1-1) as a temporary reference load value and then experimentally obtain a more accurate vibration start load value "Lc1" therefrom. With this, the initial condition of the experiment approaches an appropriate condition, it becomes easier to obtain an accurate experiment result, which can reduce repetitions of measurements. This in turn can greatly shorten the time required for the experiments, which enables to obtain the vibration start load value "Lc1" with high accuracy and efficiency.

Explaining by way of a specific example, a provisional vibration start load value "Lc1" is obtained with Formula (1-1), and its vibration start load value "Lc1" is set as an initial value to the forging device in the third embodiment, and forging forming is repeated in the same manner as described above to obtain an appropriate vibration start load value "Lc1". Thus, the vibration start load value "Lc1" can be obtained with high accuracy and efficiency.

EXAMPLE

TABLE 1

| | | Ex. 1 | Ex. 2 | Com. Ex. 1 | Com. Ex. 2 |
|---|---|---|---|---|---|
| Die | Forming hole diameter Did (mm) | 24 | Same as on the left | Same as on the left | Same as on the left |
| | Forming hole cross-sectional area Aid ($mm^2$) | 452 | | | |
| | Die body outer diameter Dod (mm) | 162 | | | |
| | Die body thickness td (mm) | 40 | | | |
| | Punch diameter Dp (mm) | 21 | | | |
| | Punch area AP ($mm^2$) | 346 | | | |
| | Material | SKD11 | | | |
| Material | Material diameter Dm (mm) | 23.5 | | | |
| | Material thickness tm (mm) | 9.3 | | | |
| | Material | A6061-O | | | |
| | Temperature | Normal temp. | | | |
| | Deformation resistance (Mpa) | 68.2 | | | |
| Vibration | Amplitude of outer circumferential surface of die body Ado [mm (p-p)] | 0.014 | | | |
| | Frequency (kHz) | 20.3 | | | |
| | Punch load at the time of vibration start (kN) | 70 | 100 | 0 | 30 |
| | Vibration stop during forming | None | None | Present | Present |
| Calculation results | Lc1 upper limit value (kN) | 40 | Same as on the left | Same as on the left | Same as on the left |
| | Lc1 lower limit value (kN) | 107 | | | |
| | Influence of forming load Lpa (kN) | 124 | | | |
| | Rσ | 0.46 | | | |
| | α min | 0.69 | | | |
| | α max | 1.87 | | | |

Examples and Comparative Examples for demonstrating the effects of the present invention will now be described.

Example 1

A forging device (see FIG. 8) similar to that of the third embodiment was prepared. In this forging device, as shown in FIG. 10, the forming hole inner diameter "Did" of the die body 11 of the die 1 was 24 mm, the forming hole cross-sectional area "Aid" was 452 $mm^2$, the outer diameter (Dod) of the die body 11 was 162 mm, and the thickness "td" of the die body 11 was 40 mm. The outside diameter "Dp" of the punch 2 was 21 mm, and the punch area "Ap" was 346 $mm^2$. Further, the material (die steel number) of each of the die 1 and the punch 2 was SKD11.

The forging material W1 to be subjected to a forging process was cylindrical. The outer diameter "Dm" of the forging material W1 was 23.5 mm, and the thickness "Tm" was 9.3 mm. The material (alloy number) of this forging material W1 was A6061-0, and the deformation resistance "σm" was 68.2 Mpa. Further, the temperature of the forging material W1 was set to room temperature.

A forged product W2 to be formed was set to have a bottomed cylindrical cup shape having an outer diameter φ of 24 mm, an inner diameter of 21 mm, and a plate thickness of 5 mm.

Under these conditions, using Formula (1-1) described in the fourth embodiment above, a punch load value (vibration start load value) "Lc1" at the timing at which the forging material W1 shifts from the insufficient contact state to the sufficient contact state was calculated. As a result, as shown in Table 1, the lower limit value of "Lc1" was 40 kN, and the upper limit value was 107 kN. The effect of the forming load "Lpa" was 124 kN, "Rσ" was 0.46, the lower limit "αmin" of "α" was 0.69, and the upper limit "αmax" was 1.87 (α=0.69 to 1.87).

Further, the vibrational amplitude "Ado" of the ultrasonic vibrations applied from the vibrator 4 to the die outer peripheral surface was set to 0.014 mm (p-p) and the frequency "f" was set to 20.3 kHz. Furthermore, the upper limit value of the output value (vibrator voltage) of the ultrasonic oscillator 5 was set to 700 V.

In Example 1, the punch load value (set load value) when starting ultrasonic vibrations was set to 70 kN which was within the range of the calculated vibration start load value "Lc1". That is, 73.5 kN which was an intermediate value of vibration start load values 40 kN to 107 kN calculated in advance was preset to the forging device (see FIG. 8) as an initial value of the reference load value "Lc1" and forging was performed, and confirmed that no overload error occurred in the ultrasonic oscillator 5 (output value was less than 700 V). Furthermore, forging were performed while slightly changing the preset reference load value "Lc1" back and forth, and 70 kN which was the lower limit value of the reference load value "Lc1" where no overload error occurred was found.

Ultrasonic forging was performed by setting 70 kN obtained as described above as a reference load value "Lc1" to the forging device. As a result, the forming was performed smoothly. Needless to say, it was confirmed that no overload error occurred and the vibration mode of the vibrator 4 was stable from the start of vibrations to the end of forming.

Example 2

As shown in Table 1, ultrasonic forging was performed in the same manner as in Example 1 except that the punch load value (reference load value) "Lc1" of starting ultrasonic vibrations was set to 100 kN which was within the range of a pre-calculated vibration start load value "Lc1".

As a result, in the same manner as in the aforementioned Example 1, the vibration mode of the vibrator 4 was stable from the start of vibrations to the end of forming, and no overload error occurred in the ultrasonic oscillator 5.

Comparative Example 1

As shown in Table 1, ultrasonic forging was performed in the same manner as in Example 1 except that the reference load value to be set to the forging device was set to 0 kN which was outside of the range of the vibration start load value "Lc1" calculated from Formula (1-1).

As a result, the vibrator voltage sharply increased to 700 V or higher, an overload error occurred in the ultrasonic oscillator 5. As a result, the ultrasonic vibrations stopped during the forming.

Comparative Example 2

As shown in Table 1, ultrasonic forging was performed in the same manner as in Example 1 except that the reference load value to be set to the forging device was set to 30 kN which was outside of the range of the vibration start load value "Lc1" calculated from Formula (1-1).

As a result, in the same manner as in the aforementioned Comparative Example 1, the vibrator voltage sharply increased to 700 V or higher, an overload error occurred in the ultrasonic oscillator 5. As a result, the ultrasonic vibrations stopped during the forming.

<Confirmation of Sufficient Contact State>

In performing forging in the same manner as in Example 1, at the time point at which the reference load value reached 70 kN, the descent of the punch was interrupted, the forging material W1 was discharged from the die 1, and the appearance of the forging material outer peripheral surface was observed. Thus, the contact state of the forging material W1 to the forming hole inner peripheral surface was confirmed.

That is, at the portion in contact with the die forming hole inner peripheral surface in the forging material W1, since the bonderizing treated surface is stretched and a newly generated surface appears, the portion where the forging material W1 was in contact with the forming hole inner peripheral surface could be confirmed by the appearance observation. As a result, the portion in which the forging material W1 was in contact with the forming hole inner peripheral surface, it was confirmed that it was distributed almost all around and in the sufficient contact state.

On the other hand, in the same manner as described above, at the time point at which the reference load value reached 30 kN, the processing by the punch was interrupted, the forging material W1 was discharged from the die 1, and the appearance of the forging material outer peripheral surface was observed. Thus, the contact state of the forging material W1 to the forming hole inner peripheral surface was confirmed. As a result, the portion in which the forging material W1 was in contact with the forming hole inner peripheral surface was one portion, in other words, the contact portion was arrange biased toward a part in the circumference direction, and it was confirmed that it was in the sufficient contact state.

When comparing this confirmation result and Examples 1 and 2 and Comparative Examples 1 and 2, when application of ultrasonic vibrations is started in the sufficient contact state, vibrations are stable and no overload error occurs. On the other hand, when application of ultrasonic vibrations is started in the insufficient contact state, it is obvious that vibrations are disturbed and an overload error occurs.

<Relationship Between Vibrator Voltage and Punch Load>

In the same manner as in the third embodiment, a vibration start load value (reference load value) "Lc1" was obtained. Note that the forging conditions were set in the same manner as those in Example 1.

Figure 11A:
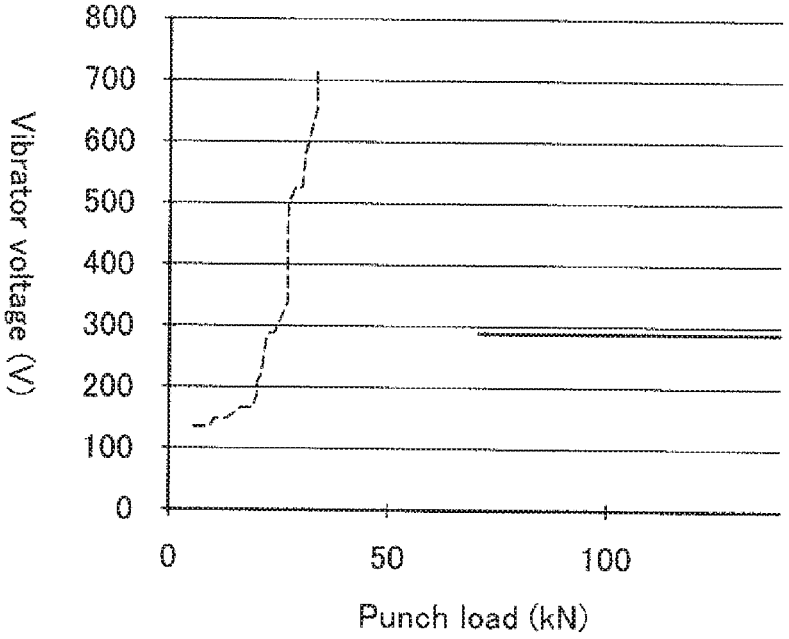
FIG. 11A is a graph showing a relationship between a vibrator voltage and a punch load in an ultrasonic forging device.

First, forging was performed by presetting the reference load value "Lc1" to 0 kN, and it was confirmed that an overload error occurred in the ultrasonic oscillator. Thereafter, while gradually increasing the reference load value "Lc1" of the presetting, the vibrator voltage value and presence or absence of an overload error were checked to thereby determine the smallest load at which no overload error occurs. As a result, the reference load value "Lc1" was 70 kN in the same manner as in Example 1. Furthermore, while gradually increasing the provisionally set reference load value "Lc1", the vibrator voltage value and presence or absence of an overload error were confirmed. The results are shown in the graph of FIG. 11A. As shown by the solid line in the figure, when the punch load as the reference load value "Lc1" was 70 kN or more, the vibrator voltage was stable below 300 V, and occurrence of overload error was not observed. On the other hand, as shown by the broken line in the figure, when the reference load value "Lc1" was 30 kN or less, the vibrator voltage was unstable and occurrence of overload error was observed.

As is apparent from the measurement results, it is understood that Examples 1 and 2 according to the present invention are superior to Comparative Examples 1 and 2 which deviate from the gist of the present invention.

<Relationship Between Vibrator Voltage and Process Time>

A forging device (see FIG. 6) shown in the second embodiment was prepared. In this forging device, the material and the size of dies, such as the die and the punch, the material and the size of the forging material, and the size of the forged product were the same as those in Example 1. Furthermore, the vibrational amplitude of the ultrasonic vibration, the frequency, and the output upper limit value of the ultrasonic oscillator were also the same as those in Example 1.

In this forging device, in the same manner as in the second embodiment, a vibration start time "Lt1" corresponding to the process elapsed time from the forming start time point to the time point at which vibrations start was obtained.

Figure 11B:
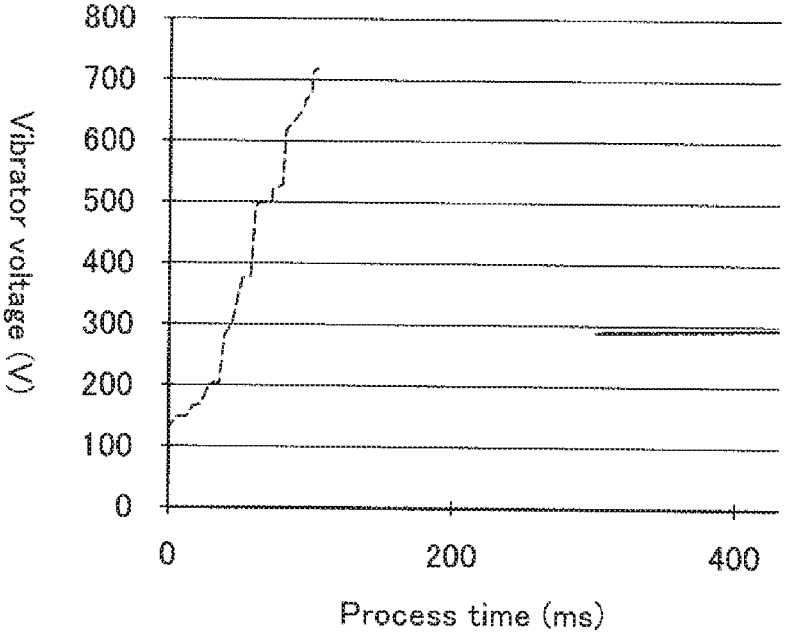
FIG. 11B is a graph showing a relationship between a vibrator voltage and a process time (forming time) in an ultrasonic forging device.

That is, forging was performed by temporarily setting the vibration start time (reference time) "Lt1" to the forming start time point, and it was confirmed that an overload error occurred in the ultrasonic oscillator. Thereafter, while gradually delaying the provisionally set reference time "Lt", the vibrator voltage value and presence or absence of overload error were checked to thereby obtain the earliest time when no overload error occurred. As a result, the reference time "Lt1" was 300 ms (milliseconds). Furthermore, while gradually delaying the preset reference time "Lt1", the vibrator voltage value and the presence or absence of an overload error were confirmed. The results are shown in the graph of FIG. 11B. As shown by the solid line in the figure, when the reference time "Lt1" was 300 ms or above, the vibrator voltage was stable below 300 V, and occurrence of overload error was not observed. On the other hand, as shown by the broken line in the figure, when the reference time "Lt1" was less than 100 ms, the vibrator voltage was unstable and occurrence of an overload error was observed.

This application claims priority to Japanese Patent Application No. 2014-207885 filed on Oct. 9, 2014, the disclosure content of which is incorporated by reference in its entirety.

The terms and expressions used herein are used for the purpose of description and not of limitation, and are not intended to exclude any equivalents of the features shown and described here and it should be understood that various modifications within the claimed scope of the present invention are allowed.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive.

INDUSTRIAL APPLICABILITY

The forging method of the present invention can be applied to a forging device, etc., adapted to perform die forging using ultrasonic vibrations.

DESCRIPTION OF SYMBOL

1: die
11: die body
12: forming hole
2: punch
4: vibrator (vibration applying means)
5: ultrasonic oscillator (vibration applying means)
7, 8: vibration start control device (vibration start means)
81: load detector (load detecting means)
A: contact point
Lc1: vibration start load value
Lt1: vibration start time
t0: forming start time
W1: forging material
θ: central angle between adjacent contact points
θmax: maximum value of central angle

The invention claimed is:

1. A forging method in which ultrasonic vibrations are applied to a die body when a forging material in a forming hole of the die body is subjected to plastic working by driving a punch into the forming hole, wherein a contact state of the forging material with respect to a forming hole inner peripheral surface in a process of subjecting the forging material to the plastic working is classified into an insufficient contact state, a sufficient contact state, and a full contact state in order from a forming start time, and wherein application of ultrasonic vibrations is started after shifting from the insufficient contact state to the sufficient contact state.

2. The forging method as recited in claim 1, wherein the application of ultrasonic vibrations is started immediately after shifting to the sufficient contact state.

3. The forging method as recited in claim 1, wherein a distance between two adjacent contact points among contact points of the forging material with respect to the forming hole inner peripheral surface along the forming hole inner peripheral surface is defined as a distance between adjacent contact points, wherein when a maximum value of the distance between adjacent contact points exceeds a half of an entire peripheral length of the forming hole, the contact state is classified as the insufficient contact state, and wherein when a maximum value of the distance between adjacent contact points is equal to or less than a half of an entire peripheral length of the forming hole, the contact state is classified as the sufficient contact state.

4. The forging method as recited in claim 1, wherein an angle formed by a line segment connecting one of adjacent two contact points among contact points of the forging material with respect to the forming hole inner peripheral surface and a forming hole center and a line segment connecting the other of the adjacent two contact points and the forming hole center is defined as a central angle between adjacent contact points, wherein when a maximum value of the central angle between adjacent contact points exceeds 180°, the contact state is classified as the insufficient contact state, and wherein when the maximum value of the central angle between adjacent contact points is 180° or less, the contact state is classified as the sufficient contact state.

5. The forging method as recited in claim 1, wherein, based on an elapsed time from a time when processing of the forging material by the punch is started, a time of shifting from the insufficient contact state to the sufficient contact state is obtained, and wherein, based on the obtained time, a timing at which application of the ultrasonic vibrations is started is determined.

6. The forging method as recited in claim 1, wherein a load of the punch against the forging material at the timing of shifting from the insufficient contact state to the sufficient contact state is obtained, and wherein, based on the obtained load, a timing at which application of ultrasonic vibrations is started is determined.

7. A forging device comprising:

a die body including a forming hole;

a punch that performs plastic working of a forging material in the forming hole by being driven into the forming hole;

vibration applying means that applies ultrasonic vibrations to the die body; and vibration start means that starts application of ultrasonic vibrations by driving the vibration applying means when a predetermined time has elapsed after start of forming the forging material by the punch.

8. A forging device comprising:

a die body including a forming hole;

a punch that performs plastic working of a forging material in the forming hole by being driven into the forming hole;

vibration applying means that applies ultrasonic vibrations to the die body; and load detecting means that detects a load of the punch against the forging material; and vibration start means that starts application of ultrasonic vibrations by driving the vibration applying means at a timing at which the load of the punch has reached a preset vibration start load value based on information from the load detecting means.

9. A forging device comprising:

a die body including a forming hole;

a punch that performs plastic working of a forging material in the forming hole by being driven into the forming hole; and vibration applying means that applies ultrasonic vibrations to the die body, wherein it is configured such that, at a timing at which a load of the punch against the forging material has reached a vibration start load value, application of the ultrasonic vibrations is started by the vibration applying means, and wherein it is configured such that following relationships are satisfied;

$$\text{“}Lc1\text{”}=\text{“}Lpa\text{”}\times\text{“}R\sigma\text{”}\times\text{“}\alpha=0.69 \text{ to } 1.87\text{”};$$

$$\text{“}Lpa\text{”}=0.3404\times\text{“}Ap\text{”}^{(0.782-[Ap]/190000)}\times\text{“}Aid\text{”}^{0.218};$$

$$\text{“}R\sigma\text{”}=0.007\times\text{“}cm\text{”}-0.016;$$

$$\text{“}\sigma m\text{”}>10 \text{ MPa; and}$$

$$\text{“}Did\text{”}-\text{“}Dm\text{”}<10 \text{ mm},$$

wherein “Lc1” is a vibration start load value, “Ap” is an area of a pressure surface of the punch, “Aid” is a cross-sectional area of the forming hole, “Did” is an inner diameter of the forming hole, “Dm” is an outer diameter of the forging material, and “σm” is a deformation resistance of the forging material.

* * * * *